US010010931B2

(12) United States Patent
Zhu et al.

(10) Patent No.: US 10,010,931 B2
(45) Date of Patent: Jul. 3, 2018

(54) CLOSED SIDE MOLD WATER SPOT COOLING APPARATUS, MANUFACTURING METHOD AND USE THEREOF

(71) Applicant: CITIC Dicastal CO., LTD, Qinhuangdao (CN)

(72) Inventors: Lin Zhu, Qinhuangdao (CN); Changhai Li, Qinhuangdao (CN); Hongbiao Li, Qinhuangdao (CN); Hongwei Zhao, Qinhuangdao (CN); Yongning Wang, Qinhuangdao (CN); Zhihua Zhu, Qinhuangdao (CN)

(73) Assignee: CITIC Dicastal CO., LTD, Qinhuangdao (CN)

( * ) Notice: Subject to any disclaimer, the term of this patent is extended or adjusted under 35 U.S.C. 154(b) by 294 days.

(21) Appl. No.: 14/993,215

(22) Filed: Jan. 12, 2016

(65) Prior Publication Data

US 2016/0199903 A1 Jul. 14, 2016

(30) Foreign Application Priority Data

Jan. 12, 2015 (CN) ..... 2015 1 0011653

(51) Int. Cl.
*B22C 9/06* (2006.01)
*B22D 18/04* (2006.01)

(52) U.S. Cl.
CPC ..... *B22C 9/065* (2013.01); *B22D 18/04* (2013.01)

(58) Field of Classification Search
CPC ..... B22C 9/06; B22D 18/04
See application file for complete search history.

(56) References Cited

U.S. PATENT DOCUMENTS 8,047,262 B2 * 11/2011 Kweon ..... B22D 30/00 164/284
9,707,620 B2 * 7/2017 Zhu ..... B22D 30/00
9,713,837 B2 * 7/2017 Zhu ..... B22C 9/065

* cited by examiner

*Primary Examiner* — Ryan J Walters
(74) *Attorney, Agent, or Firm* — Maier & Maier, PLLC

(57) ABSTRACT

The present invention provides a water spot cooling apparatus, a water spot cooling method for casting a mold, a method for manufacturing the water spot cooling apparatus and use of the water spot cooling apparatus. The technical solution of the present invention has the following advantages: spot cooling of multiple spots can be realized on each side mold by using only one water inlet pipeline, thereby saving the water cooling pipeline and facilitating field installation; the water inlet and outlet are integrated on a main body, thereby facilitating field implementation; the whole apparatus is easy to process, convenient to maintain, and low in manufacturing cost; and it is not restricted by the product structure and facilitates promotion.

6 Claims, 1 Drawing Sheet

CLOSED SIDE MOLD WATER SPOT COOLING APPARATUS, MANUFACTURING METHOD AND USE THEREOF

TECHNICAL FIELD

The present invention relates to the casting field, and in particular, to a side mold water spot cooling apparatus using a closed backwater structure.

BACKGROUND ART

In the field of low pressure casting of aluminum vehicle wheels, a water-cooled mold has become the development trend of the metal mold of the aluminum vehicle wheel because of its unique advantages.

However, in our many years of practice, it has been found that the using effect of the water-cooled mold of a conventional annular cooling channel is not very desirable. Through analysis and repeated verification, it has been found that the essential reason why the using effect of the annular cooling channel is undesirable is that the annular cooling channel also cools the places where cooling is not required in addition to those where cooling is required, and the smooth use of the wind-cooled mold is good evidence.

However, due to the inherent defect of wind cooling, i.e., small cooling intensity, the wind cooling is quite limited in the improvement of production efficiency and the enhancement of casting quality. Furthermore, wind has the disadvantages of non-recoverability and non-recyclability, which results in the waste of resources.

Therefore, developing an apparatus which is capable of achieving the goal of spot cooling and cannot be restricted by the product structure becomes the key for the successful promotion of the water-cooled mold in industry of aluminum vehicle wheels. The present invention aims to provide a cooling apparatus capable of realizing side mold water spot cooling.

SUMMARY OF THE INVENTION

Hence, the objective of the present invention is to provide a water spot cooling apparatus, manufacturing method and use thereof, thereby overcoming the above technical problems. Therefore, the present invention provides the following technical solution:

In one aspect of the present invention, a water spot cooling apparatus is provided, characterized in that the apparatus comprises: (1) a spot cooling apparatus main body 1, comprising a backwater cross hole 7 which is parallel to the surface of a mold and passes through the spot cooling apparatus main body 1, a through hole 2' perpendicular to the surface of the mold, and through holes 10' located around the through hole 2' for fastening screws, the backwater cross hole 7 being in fluid connection with the through hole 2'; (2) a water inlet branch pipe 3 passing through the through hole 2' and installed in the spot cooling apparatus main body 1 towards the surface of the mold, a water inlet connecting joint 2 connected to the tail end of the water inlet branch pipe 3, a sealed connecting ballhead 12 connected to the tail end of the water inlet connecting joint 2, and a water inlet manifold 4 connected to the tail end of the sealed connecting ballhead 12, and the outer diameter of the water inlet branch pipe 3 being less than the inner diameter of the through hole 2'; (3) a backwater joint 8 connected with the backwater cross hole 7, and the backwater cross hole 7 and the backwater joint 8 being connected via a sealing gasket 9; and (4) a fastening screw 10 used for fixing the spot cooling apparatus main body 1 to the surface of the mold.

In a preferred aspect of the present invention, the apparatus comprises three through holes 10' for fastening the screws around each through hole 2'; preferably, the through holes 10' are distributed to form a 120° angle with respect to each other.

In a preferred aspect of the present invention, the sealed connecting ballhead 12 and the water inlet connecting joint 2 are sealed by means of spherical fit.

In a preferred aspect of the present invention, the backwater cross hole 7 is fluidly connected with the through hole 2' via a backwater vertical hole 5 and a backwater inclined hole 6.

In a preferred aspect of the present invention, both ends of the backwater cross hole 7 are scaled by means of plug welding or plugs.

In another aspect of the present invention, a method for water spot cooling of a mold is provided, characterized in that the method comprises the following steps: (1) processing blind holes on the locations of the mold wall where cooling is required, the blind holes corresponding to the locations of the water inlet branch pipes 3 of the apparatus described above; (2) installing and fixing the apparatus described above onto the mold wall, and inserting the water inlet branch pipes 3 into the blind holes; and (3) introducing cooling water into the water inlet manifold 4 of the apparatus, the pressure of the cooling water is 0.4 to 0.6 atm and the temperature of the cooling water is 25 to 35° C.

In another aspect of the present invention, a method for manufacturing the apparatus described above is provided, characterized in that the method comprises the following steps: (1) processing a spot cooling apparatus main body 1; (2) processing a water inlet branch pipe 3, welding the same together with the water inlet connecting joint 2, and then screwing the water inlet connecting joint 2 into the spot cooling apparatus main body 1; (3) welding the sealed connecting ballhead 12 together with the water inlet manifold 4; (4) installing the spot cooling apparatus main body 1 on the mold and fixing the same with a screw 10; (5) butting the water inlet manifold 4, together with the sealed connecting ballhead 12 to the water inlet connecting joint 2; (6) installing the backwater joint 8 on the spot cooling apparatus main body 1; and (7) butting the water inlet and outlet joints of a rack to the water inlet and outlet joints of the spot cooling apparatus.

In another aspect of the present invention, use of the apparatus described above in the water spot cooling process of the mold is provided.

In another aspect of the present invention, the following technical solution is further provided:

In another aspect of the present invention, the present invention provides a side mold water spot cooling apparatus using a closed backwater structure, the apparatus can be widely applied to side mold spot cooling of water-cooled molds casted at a low pressure for aluminum vehicle wheels and is not restricted by the product structure.

In another aspect of the present invention, the following technical solution is provided:

A closed backwater side mold water spot cooling apparatus, comprising a spot cooling apparatus main body 1, a water inlet pipeline system (2, 3, 4, 12) and a backwater pipeline system (5, 6, 7, 8). The water inlet pipeline system is constituted by a water inlet connecting joint 2, a water inlet branch pipe 3, a water inlet manifold 4, and a sealed connecting ballhead 12; the water inlet branch pipe and the water inlet connecting joint 2 are connected by welding. The water inlet connecting joint 2 is connected with the spot cooling apparatus main body 1 by means of taper pipe thread, and a high-temperature glue is used for enhancing the sealing effect. The water inlet connecting joint 2 and the seal connecting joint 12 are sealed by means of spherical fit. The backwater pipeline system is constituted by a backwater vertical hole 5, a backwater inclined hole 6, a backwater cross hole 7 and a joint 8. The joint 8 is connected with the spot cooling apparatus main body by means of fine-pitch thread and is sealed by adding a sealing gasket 9 onto an assembly plane. The spot cooling apparatus main body 1 is fastened to the mold via three screws 10 that form a 120° angle with respect to each other at the periphery of each spot cooling hole.

In another aspect of the present invention, the following technical solution is further provided:

In one aspect, a closed backwater side mold water spot cooling apparatus is provided, comprising a spot cooling apparatus main body 1, a water inlet pipeline system and a backwater pipeline system. It is characterized in that: the water inlet pipeline system is composed of common water pipes and joints; and the backwater pipeline system is composed of a plurality of blind holes or through holes that are intersected with each other. In one aspect, a closed backwater side mold water spot cooling apparatus as described above is provided, characterized in that: the water inlet pipeline system is composed of a water inlet connecting joint 2, a water inlet branch pipe 3, a water inlet manifold 4, and a sealed connecting ballhead 12. The sealed connecting ballhead 12 and the water inlet connecting joint 2 are sealed by means of spherical fit.

In one aspect, a closed backwater side mold water spot cooling apparatus as described above is provided, characterized in that: the backwater pipeline system is constituted by a backwater vertical hole 5, a backwater inclined hole 6 and a backwater cross hole 7 which are intersected with the through holes in the backwater joint 8 two by two. The backwater cross hole 7 is the through hole in the spot cooling apparatus main body 1, and both ends thereof are sealed by means of plug welding or plugs.

In one aspect, a closed backwater side mold water spot cooling apparatus as described above is provided, characterized in that: the spot cooling apparatus main body 1 is fixed to the mold via the screws that form a 120° angle with respect to each other at the periphery of each spot cooling hole.

The closed backwater side mold water spot cooling apparatus of the present invention is not limited to the content described in the Summary of the Invention and the Detailed Description of the Invention. Other modes of design obtained according to disclosure of the present invention all fall within the scope of protection of the present invention.

The technical solution of the present invention has the following advantages:

(1) each side mold can realize spot cooling of multiple spots by using only one water inlet pipeline side mold, thereby saving the water cooling pipeline and facilitating field installation;

(2) the water inlet and outlet are integrated on a main body, thereby facilitating field implementation;

(3) the whole apparatus is easy to process, convenient to maintain, and low in manufacturing cost; and (4) it is not restricted by the product structure and facilitates promotion.

BRIEF DESCRIPTION OF THE DRAWINGS

Embodiments of the present invention will be described in detail below with reference to the accompany drawings, wherein.

DETAILED DESCRIPTION OF THE INVENTION

Embodiment 1: Manufacture of the Water Side Mold Spot Cooling Apparatus

Figure 1:
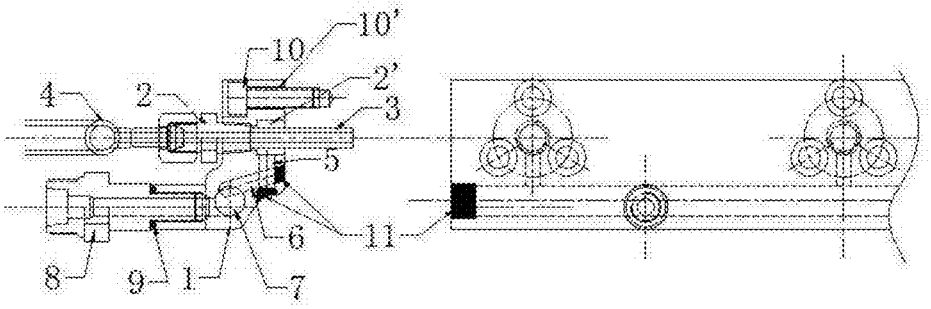
FIG. 1: a schematic diagram of a closed backwater side mold water spot cooling apparatus of embodiment 1 of the present invention, wherein: 1—spot cooling apparatus main body, 2—water inlet connecting joint, 2'—through hole, 3—water inlet branch pipe, 4—water inlet manifold, 5—backwater vertical hole, 6—backwater inclined hole, 7—backwater cross hole, 8—backwater joint, 9—sealing gasket, 10—fastening screw, 10'—fastening screw through hole, 11—plug welding seal, 12—scaled connecting ballhead.
Figure 2:
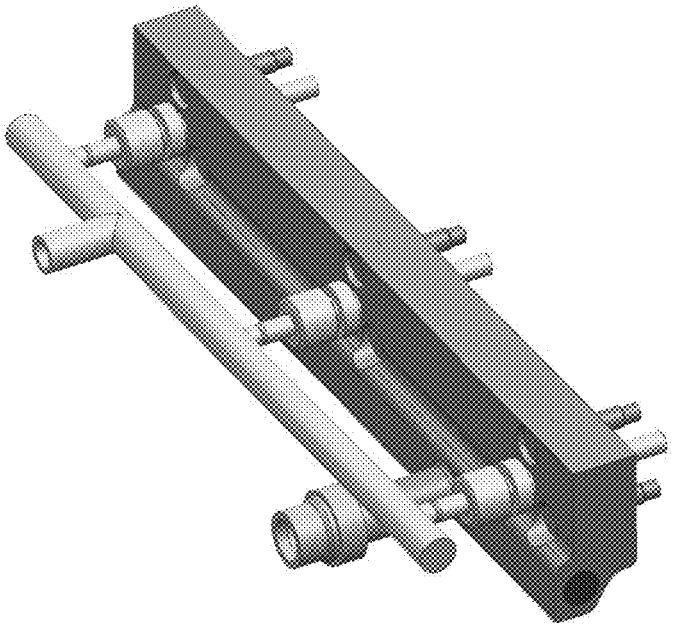
FIG. 2: a 3D model schematic diagram of the closed backwater side mold water spot cooling apparatus of the present invention.

A closed backwater side mold water spot cooling apparatus, comprising a spot cooling apparatus main body 1, a water inlet pipeline system and a backwater pipeline system. The structure of the apparatus is as shown in FIG. 1.

A water inlet branch pipe 3 of a predetermined length is manufactured, and is welded together with the water inlet connecting joint 2, and then the water inlet connecting joint 2 is screwed into the spot cooling apparatus main body 1. The sealed connecting ballhead 12 is welded together with the water inlet manifold 4. The spot cooling apparatus main body 1 is installed on the mold and is fixed with a screw 10. The water inlet manifold 4, together with the sealed connecting ballhead 12 is butted to the water inlet connecting joint 2. The backwater joint 8 is installed on the spot cooling apparatus main body 1. The water inlet and outlet joints of the rack are butted to the water inlet and outlet joints of the spot cooling apparatus. The closed backwater side mold water spot cooling apparatus fully absorbs the advantages of side mold cooling by a wind-cooled mold, and can realize the spot cooling of castings merely by processing a number of blind holes at the locations on the mold where cooling is required, thereby getting rid of the restrictions of the product structure to the spot cooling implementation.

Embodiment 2: The Cooling Effect of the Water Side Mold Spot Cooling Apparatus The water side mold spot cooling apparatus of embodiment 1 is installed on a low-pressure cast side mold of a hub; the method is as follows:

(1) Blind holes are processed on the locations of the mold wall where cooling is required, the blind holes correspond to the locations of the water inlet branch pipes 3 of the apparatus according to any one of claims 1 to 5; and (2) The apparatus according to any one of claims 1 to 5 is installed and fixed onto the mold wall, and the water inlet branch pipes 3 are inserted into the blind holes.

Moreover, thermocouples are installed at the thermal centers to measure temperature of the side mold.

After the installation is completed, cooling water is introduced into the water inlet manifold 4 of the apparatus, the pressure of the cooling water is 0.5 atm and the temperature of the cooling water is 25° C.

The following data is obtained by observation after cooling for 1.5 minutes:

time: 0 minute; temperature: 470° C.;

time: 1.5 minutes; temperature: 370° C.;

In view of the above, the water side mold spot cooling apparatus of the present invention can effectively reduce the temperature of the side mold in a desired manner.

The invention claimed is:

1. A water spot cooling apparatus, comprising:

a spot cooling apparatus main body, comprising a backwater cross hole which is parallel to a surface of a mold and passes through the spot cooling apparatus main body, a through hole perpendicular to the surface of the mold, and fastener through holes located around the through hole for fastening screws, the backwater cross hole being in fluid connection with the through hole;

a water inlet branch pipe passing through the through hole and installed in the spot cooling apparatus main body towards the surface of the mold, a water inlet connecting joint connected at a tail end of the water inlet branch pipe, a sealed connecting ballhead connected at a tail end of the water inlet connecting joint, and a water inlet manifold connected at a tail end of the sealed connecting ballhead, the outer diameter of the water inlet branch pipe being less than the inner diameter of the through hole;

a backwater joint connected with the backwater cross hole, and the backwater cross hole and the backwater joint being connected via a sealing gasket; and a fastening screw used for fixing the spot cooling apparatus main body to the surface of the mold.

2. The apparatus according to claim 1, wherein the fastener through holes comprise three fastener through holes for fastening the fastening screws around the through hole; wherein, the fastener through holes are distributed to form a 120° angle with respect to each other.

3. The apparatus according to claim 1, wherein the backwater cross hole is fluidly connected with the through hole via a backwater vertical hole and a backwater inclined hole.

4. The apparatus according to claim 1, wherein both ends of the backwater cross hole are sealed by means of plug welding or plugs.

5. A water spot cooling method for casting a mold, comprising:

processing blind holes on the locations of a mold wall where cooling is required, the blind holes corresponding to the locations of the water inlet branch pipes of the apparatus according to claim 1;

installing and fixing the apparatus according to claim 1 onto the mold wall, and inserting the water inlet branch pipes into the blind holes; and introducing cooling water into the water inlet manifold of the apparatus, the pressure of the cooling water being 0.4 to 0.6 atm and the temperature of the cooling water being 25 to 35° C.

6. A method for manufacturing the apparatus according to claim 1, comprising:

processing a spot cooling apparatus main body;

processing a water inlet branch pipe, welding the same together with the water inlet connecting joint, and then screwing the water inlet connecting joint into the spot cooling apparatus main body;

welding the sealed connecting ballhead together with the water inlet manifold;

installing the spot cooling apparatus main body on the mold and fixing the same with a screw;

butting the water inlet head pipe, together with the sealed connecting ballhead to the water inlet connecting joint;

installing the backwater joint on the spot cooling apparatus main body; and butting the water inlet and outlet joints of a rack to the water inlet and outlet joints of the spot cooling apparatus.

* * * * *